US008266911B2

(12) United States Patent
Evulet

(10) Patent No.: US 8,266,911 B2
(45) **Date of Patent: *Sep. 18, 2012**

(54) PREMIXING DEVICE FOR LOW EMISSION COMBUSTION PROCESS

(75) Inventor: Andrei Tristan Evulet, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 1647 days.

This patent is subject to a terminal disclaimer.

(21) Appl. No.: 11/273,212

(22) Filed: Nov. 14, 2005

(65) Prior Publication Data

US 2007/0107436 A1 May 17, 2007

(51) Int. Cl.
*F02C 1/00* (2006.01)
*F02G 3/00* (2006.01)

(52) U.S. Cl. ..... 60/737; 60/752; 60/740

(58) Field of Classification Search ..... 60/737, 60/748, 740, 742, 746, 747, 752
See application file for complete search history.

(56) References Cited

U.S. PATENT DOCUMENTS 2,948,117 A * 8/1960 Nerad et al. ..... 60/746
3,143,401 A * 8/1964 Lambrecht ..... 48/180.1
3,631,675 A 1/1972 Keiter et al.
3,695,820 A * 10/1972 Hawkes et al. ..... 431/354
3,740,945 A * 6/1973 Lovingham ..... 60/204
3,744,242 A 7/1973 Stettler et al.
3,792,582 A * 2/1974 Markowski ..... 60/737
3,826,083 A 7/1974 Brandon et al.
3,876,362 A 4/1975 Hirose
3,915,622 A * 10/1975 Desty et al. ..... 431/284
3,947,216 A * 3/1976 Teodorescu et al. ..... 431/352
3,954,382 A * 5/1976 Hirose ..... 431/9
4,037,991 A * 7/1977 Taylor ..... 417/80
4,073,613 A * 2/1978 Desty ..... 431/202
4,125,361 A * 11/1978 Bourn ..... 431/354
4,199,934 A * 4/1980 Meyer ..... 60/39.23
4,332,547 A * 6/1982 MacDonald, Jr. ..... 431/242
4,336,017 A * 6/1982 Desty ..... 431/202
5,085,039 A 2/1992 Shekleton
5,251,447 A * 10/1993 Joshi et al. ..... 60/737
5,274,995 A * 1/1994 Horner et al. ..... 60/39.55
5,351,477 A * 10/1994 Joshi et al. ..... 60/39.463
5,658,358 A * 8/1997 Chyou et al. ..... 48/180.1
5,680,766 A * 10/1997 Joshi et al. ..... 60/746
5,778,676 A * 7/1998 Joshi et al. ..... 60/746
5,816,049 A * 10/1998 Joshi ..... 60/737
5,865,024 A * 2/1999 Kress et al. ..... 60/39.463
6,050,096 A * 4/2000 Senior ..... 60/748
6,122,917 A * 9/2000 Senior ..... 60/752
6,301,900 B1 * 10/2001 Mandai et al. ..... 60/740
6,343,927 B1 * 2/2002 Eroglu et al. ..... 431/1
6,389,798 B1 * 5/2002 Tilston et al. ..... 60/39.23
6,418,726 B1 * 7/2002 Foust et al. ..... 60/776
7,175,423 B1 * 2/2007 Pisano et al. ..... 431/10
7,237,384 B2 * 7/2007 Stuttaford et al. ..... 60/776

(Continued)

*Primary Examiner* — William H Rodriguez
(74) *Attorney, Agent, or Firm* — Francis T. Coppa

(57) ABSTRACT

A premixing device is provided. The premixing device includes an air inlet configured to introduce compressed air into a mixing chamber of the premixing device and a fuel plenum configured to provide a fuel to the mixing chamber via a circumferential slot and over a pre-determined profile adjacent the fuel plenum, wherein the pre-determined profile facilitates attachment of the fuel to the profile to form a fuel boundary layer and to entrain incoming air through the fuel boundary layer to facilitate mixing of fuel and air in the mixing chamber.

30 Claims, 9 Drawing Sheets

U.S. PATENT DOCUMENTS

| | | | | |
|---|---|---|---|---|
| 7,434,401 | B2 * | 10/2008 | Hayashi | 60/743 |
| 7,506,496 | B2 * | 3/2009 | Mantchenkov et al. | 60/39.461 |
| 2008/0078182 | A1 * | 4/2008 | Evulet | 60/776 |
| 2008/0104961 | A1 * | 5/2008 | Bunker | 60/737 |
| 2008/0110173 | A1 * | 5/2008 | Bunker | 60/737 |
| 2008/0134685 | A1 * | 6/2008 | Bunker et al. | 60/776 |
| 2008/0163627 | A1 * | 7/2008 | ELKady et al. | 60/737 |
| 2008/0315042 | A1 * | 12/2008 | Evulet et al. | 244/53 B |
| 2009/0100837 | A1 * | 4/2009 | Von Der Bank | 60/737 |
| 2009/0314000 | A1 * | 12/2009 | Evulet et al. | 60/772 |

* cited by examiner

210

| 216 TIME | 218 % TRAVERSE | 220 % He | 222 % $O_2$ | 224 % $CO(N_2)$ |
|---|---|---|---|---|
| 10:25 am | 50% (6.0) | 49.35% | 12.95% | 38.02% |
| 10:30 am | 56.3% (5.5) | 50.32% | 12.85% | 36.34% |
| 10:35 am | 62.6% (6.0) | 50.7% | 13.05% | 36.16% |
| 10:40 am | 68.9% (6.5) | 51.63% | 12.23% | 36.4% |
| 10:45 am | 75.2% (7.0) | 50.94% | 12.15% | 35.7% |
| 10:50 am | 81.5% (7.5) | 52.57% | 12.1% | 35.6% |
| 10:55 am | 87.8% (8.0) | 49.80% | 12.96% | 38.58% |
| 11.00 am | 94.5% (8.5) | 41.00% | 14.26% | 41.2% |
| 11.05 am | 100.4% (9.0) | 25% | 18.76% | 51.8% |
| 11.10 am | 106.7% (9.5) | 21.12% | 20.6% | 60.56% |

212

| 216 | 218 | 220 | 222 | 224 |
|---|---|---|---|---|
| 11.15 am | 106.7% (9.5) | 13.7% | 23.17% | 64.71% |
| 11.17 am | 100.4% (9.0) | 26.63% | 19.57% | 54.07% |
| 11.20 am | 94.5% (8.5) | 35.8% | 17.0% | 47.9% |
| 11.23 am | 87.8% (8.0) | 42.85% | 15.03% | 42.01% |
| 11.26 am | 81.5% (7.5) | 46.4% | 13.96% | 39.87% |
| 11.29 am | 75.2% (7.0) | 45.11% | 14.56% | 40.59% |
| 11.32 am | 68.9% (6.5) | 40.10% | 15.4% | 45.42% |
| 11.35 am | 62.6% (6.0) | 31.9% | 17.4% | 48.9% |
| 11.38 am | 56.3% (5.5) | 30.07% | 17.84% | 49.13% |
| 11.41 am | 50% (5.0) | 32.46% | 18.7% | 50.12% |

214

FIG. 11

PREMIXING DEVICE FOR LOW EMISSION COMBUSTION PROCESS

BACKGROUND

The invention relates generally to combustors, and more particularly to a premixing device for application in low emission combustion processes.

Various types of combustors are known and are in use. For example, can type, can-annular or annular combustors are employed in aeroderivative gas turbines for applications such as power generation, marine propulsion, gas compression, cogeneration, offshore platform power and so forth. Typically, the combustors for the gas turbines are designed to minimize emissions such as $NO_x$ and carbon dioxide emissions.

In certain traditional systems, the reduction in emissions from the combustors is achieved through premixed flames. The fuel and air are mixed prior to combustion and the mixing is achieved by employing cross-flow injection of fuel and subsequent dissipation and diffusion of the fuel in the air flow. Typically, fuel jets are positioned between vanes of a swirler or on the surface of the vane airfoils. However, this cross-flow injection of fuel generates islands of high and low concentrations of fuel-to-air ratios within the combustor, thereby resulting in substantially high emissions. Further, such cross-flow injection results in fluctuations and modulations in the combustion processes due to the fluctuations in the fuel pressure and the pressure oscillations in the combustor that may result in destructive dynamics within the combustion process.

Similarly, in certain other systems that require premixing of air and a gaseous fuel prior to combustion, it may be challenging to reduce the emissions and the pressure fluctuations within a combustion area. For example, in gas range systems diffusion flames result in high levels of emissions and relatively inefficient operation as the degree of premixing required for such processes is difficult to achieve.

Accordingly, there is a need for a premixer for lean operation of combustors employed in gas turbines while achieving reduced $NO_x$ emissions from the combustor. It would also be advantageous to provide a combustor for a gas turbine that will work on a variety of fuels, while maintaining acceptable levels of pressure fluctuations within the combustor. Furthermore, it would be desirable to provide a combustor having capability of employing high or pure hydrogen as fuel without the occurrence of flashbacks or burnouts.

BRIEF DESCRIPTION

Briefly, according to one embodiment a premixing device is provided. The premixing device includes an air inlet configured to introduce compressed air into a mixing chamber of the premixing device and a fuel plenum configured to provide a fuel to the mixing chamber via a circumferential slot and over a pre-determined profile adjacent the fuel plenum, wherein the pre-determined profile facilitates attachment of the fuel to the profile to form a fuel boundary layer and to entrain incoming air through the fuel boundary layer to facilitate mixing of fuel and air in the mixing chamber.

In another embodiment, a low emission combustor is provided. The low emission combustor includes a combustor housing defining a combustion area and a premixing devices coupled to the combustor. The premixing device includes an air inlet to introduce air inside the premixing device, a fuel plenum configured to provide a fuel to the premixing device via a circumferential slot and at least one surface of the premixing device having a pre-determined profile, wherein the profile is configured to facilitate attachment of the fuel to the profile to form a boundary layer and to entrain incoming air from the air inlet to promote the mixing of air and fuel.

In another embodiment, a method for premixing a fuel and oxidizer in a combustion system is provided. The method includes drawing the oxidizer inside a premixing device through an oxidizer inlet and injecting the fuel into the premixing device through a circumferential slot. The method also includes deflecting the injected fuel towards a pre-determined profile within the premixing device to form a fuel boundary layer and entraining the oxidizer through the fuel boundary layer to facilitate mixing of the fuel and oxidizer to form a fuel-air mixture.

DRAWINGS

These and other features, aspects, and advantages of the present invention will become better understood when the following detailed description is read with reference to the accompanying drawings in which like characters represent like parts throughout the drawings, wherein:

FIG. 11 represents exemplary results 210 illustrating degree of premixedness of the premixing device with helium doping using atmospheric air.

DETAILED DESCRIPTION

Figure 1:
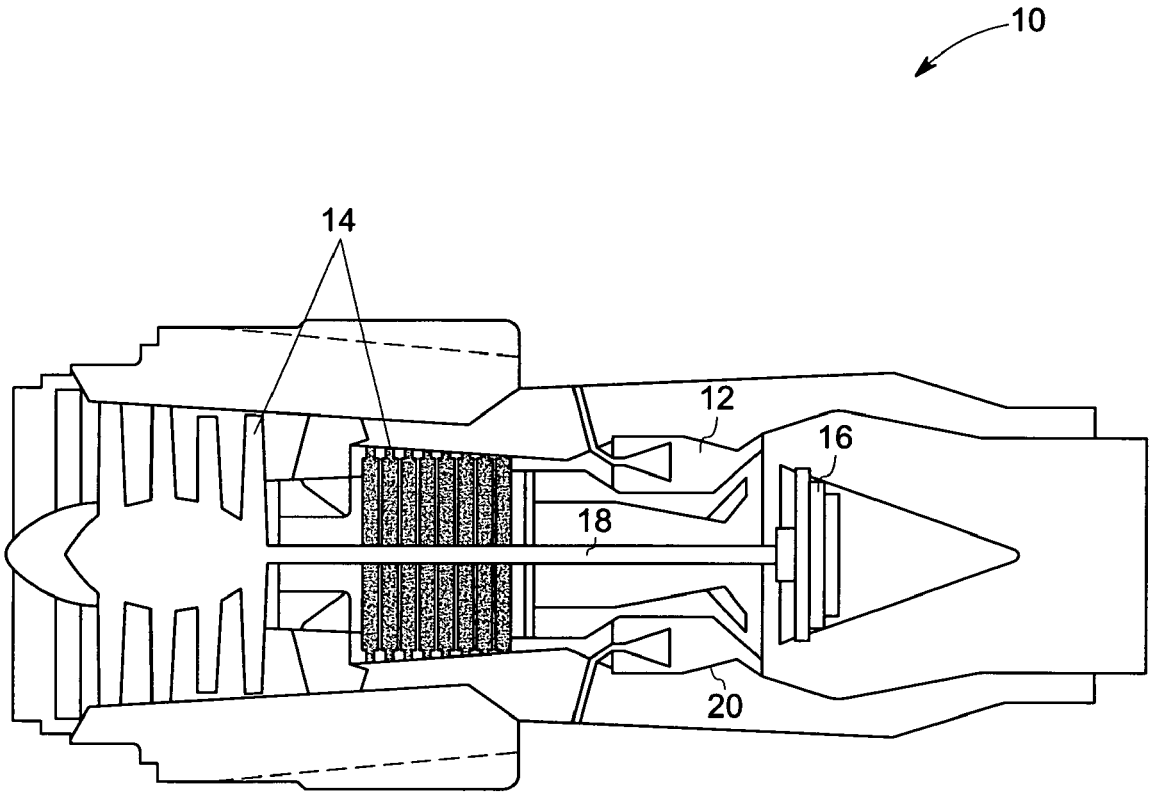
FIG. 1 is a diagrammatical illustration of a gas turbine having combustor with a premixing device in accordance with aspects of the present technique.

As discussed in detail below, embodiments of the present technique function to reduce emissions in combustion processes in various applications such as in gas turbine combustors, gas ranges and internal combustion engines. In particular, the present technique employs a premixing device upstream of a combustion area for enhancing the mixing of air and a gaseous fuel prior to combustion in the combustion area. Turning now to drawings and referring first to FIG. 1 a gas turbine 10 having a low emission combustor 12 is illustrated. The gas turbine 10 includes a compressor 14 configured to compress ambient air. The combustor 12 is in flow communication with the compressor 14 and is configured to receive compressed air from the compressor 14 and to combust a fuel stream to generate a combustor exit gas stream. In one embodiment, the combustor 12 includes a can combustor. In an alternate embodiment, the combustor 12 includes a can-annular combustor or a purely annular combustor. In addition, the gas turbine 10 includes a turbine 16 located downstream of the combustor 12. The turbine 16 is configured to expand the combustor exit gas stream to drive an external load. In the illustrated embodiment, the compressor 14 is driven by the power generated by the turbine 16 via a shaft 18.

In the illustrated embodiment, the combustor 12 includes a combustor housing 20 defining a combustion area. In addition, the combustor 12 includes a premixing device for mixing compressed air and fuel stream prior to combustion in the combustion area. In particular, the premixing device employs a Coanda effect to enhance the mixing efficiency of the device that will be described below with reference to FIGS. 2-5. As used herein, the term "Coanda effect" refers to the tendency of a stream of fluid to attach itself to a nearby surface and to remain attached even when the surface curves away from the original direction of fluid motion.

Figure 2:
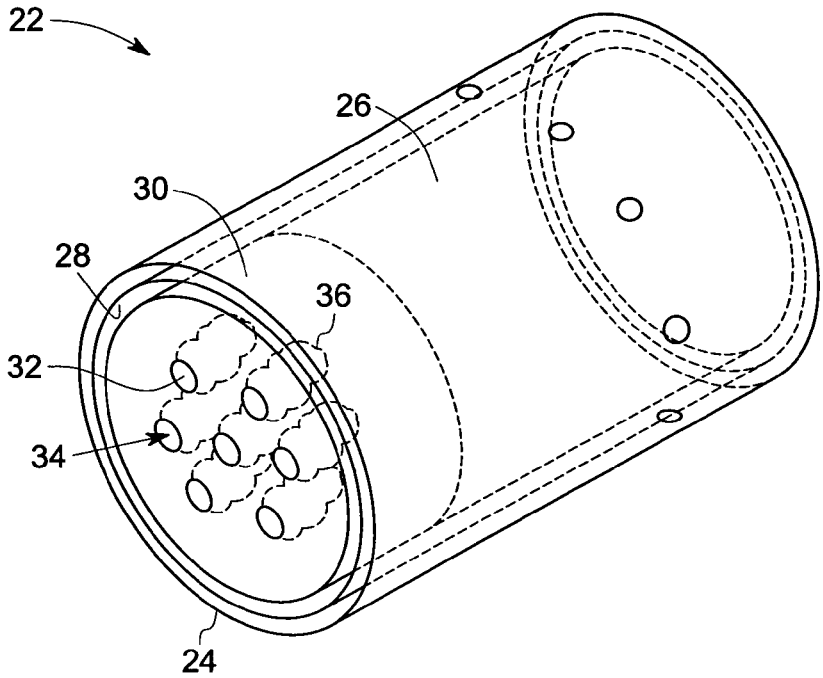
FIG. 2 is a diagrammatical illustration of an exemplary configuration of a low emission combustor employed in the gas turbine of FIG. 1 in accordance with aspects of the present technique.

FIG. 2 is a diagrammatical illustration of an exemplary configuration of the low emission combustor 22 employed in the gas turbine 10 of FIG. 1. In the illustrated embodiment, the combustor 22 comprises a can combustor. The combustor 22 includes a combustor casing 24 and a combustor liner 26 disposed within the combustor casing 24. In addition, the combustor 22 includes a dome plate 28 and a heat shield 30 configured to reduce temperature of the combustor walls. Further, the combustor 22 includes a plurality of premixing devices 32 for premixing the air and fuel prior to combustion. In one embodiment, the plurality of premixing devices 32 may be arranged to achieve staged fuel introduction within the combustor 22 for applications employing fuels such as hydrogen. In operation, the premixing device 32 receives an airflow 34 and is premixed with the fuel from a fuel plenum. Subsequently, the air-fuel mixture is combusted in the combustor 22, as represented by reference numeral 36.

Figure 3:
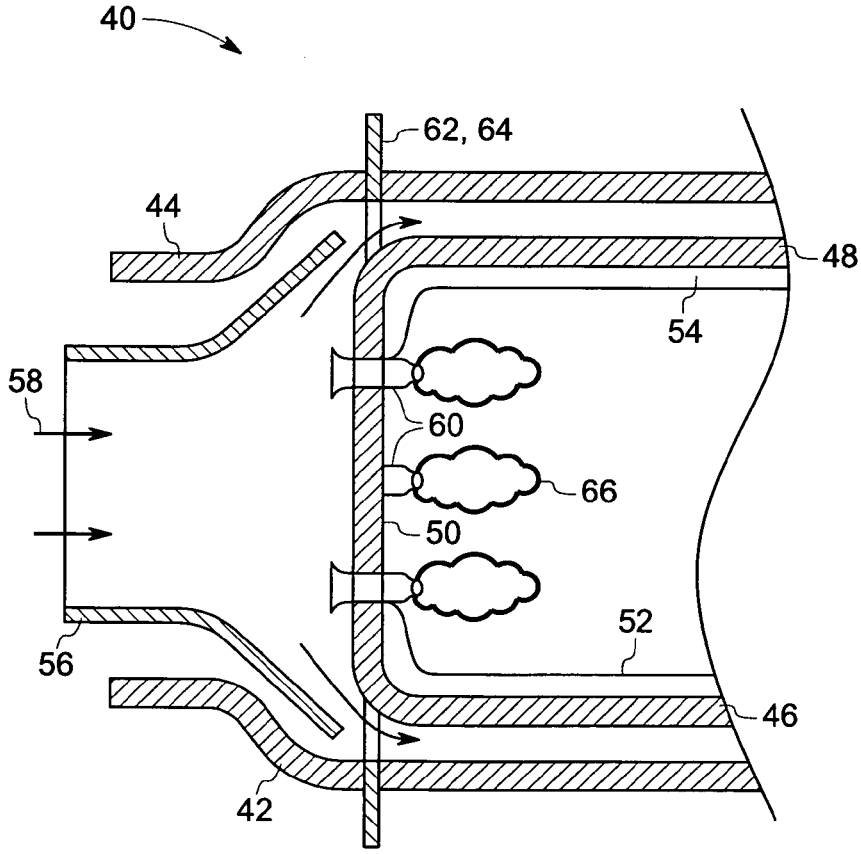
FIG. 3 is a diagrammatical illustration of another exemplary configuration of the low emission combustor employed in the gas turbine of FIG. 1 in accordance with aspects of the present technique.

FIG. 3 is a diagrammatical illustration of another exemplary configuration 40 of the low emission combustor employed in the gas turbine 10 of FIG. 1. In the illustrated embodiment, the combustor 40 comprises an annular combustor. As illustrated, the combustion area within the combustor 40 is defined by the combustor inner and outer casing as represented by reference numeral 42 and 44, respectively. In addition, the combustor 40 typically includes inner and outer combustor liners 46 and 48 and a dome plate 50 disposed within the combustor 40. Further, the combustor 40 includes inner and outer heat shields 52 and 54 disposed adjacent to the inner and outer combustor liners 46 and 48 and a diffuser section 56 for directing an air flow 58 inside the combustion area. The combustor 40 also includes a plurality of premixing devices 60 disposed upstream of the combustion area. In operation, a respective premixing device 60 receives fuel from a fuel plenum via fuel lines 62 and 64, which fuel is directed to flow over a pre-determined profile inside the premixing device 60 for enhancing the mixing efficiency of the premixing device 60 and entraining air using the Coanda effect. Further, the fuel from the fuel lines 62 and 64 is mixed with the incoming air flow 58 to form a fuel-air mixture for combustion 66. In this embodiment, the introduction of fuel alters the air splits within the combustor 40. Particularly, the dilution air is substantially reduced and the combustion air split increases within the combustor 40 due to change in pressure on account of the Coanda effect. The details of the premixing device 60 with the pre-determined profile will be described in detail below with reference to FIGS. 4 and 5.

Figure 4:
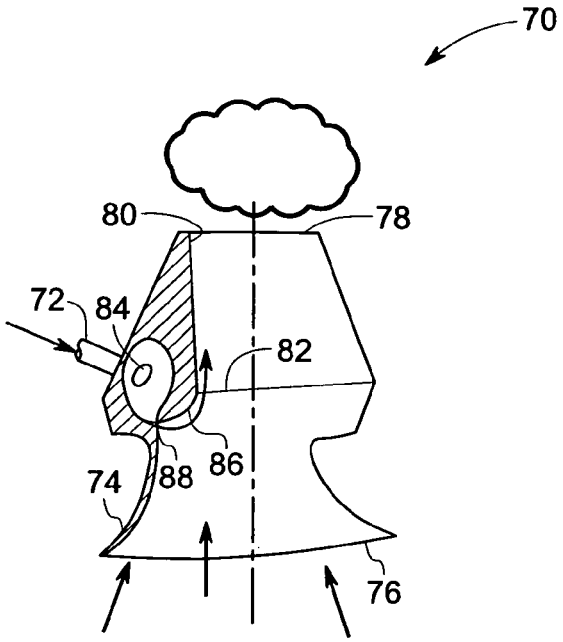
FIG. 4 is a diagrammatical illustration of an exemplary configuration of the premixing device employed in the combustors of FIGS. 2 and 3 in accordance with aspects of the present technique.

FIG. 4 is a diagrammatical illustration of an exemplary configuration 70 of the premixing device employed in the combustors of FIGS. 2 and 3. In the embodiment, illustrated in FIG. 4 the premixing device 70 includes a fuel line 72 for directing the fuel inside a fuel plenum of the premixing device 70. The air inlet nozzle profile of the premixing device 70 and the air inlet are represented by reference numerals 74 and 76. In addition, the premixing device 70 includes a nozzle outlet 78, a diffuser wall 80 and a throat area 82. The premixing device 70 receives the fuel from a fuel plenum 84 and the fuel is directed to flow over a pre-determined profile 86 or over a set of slots or orifices through a fuel outlet annulus 88. Subsequently, the fuel is mixed with incoming air from the air inlet 76 to form a fuel-air mixture.

Figure 5:
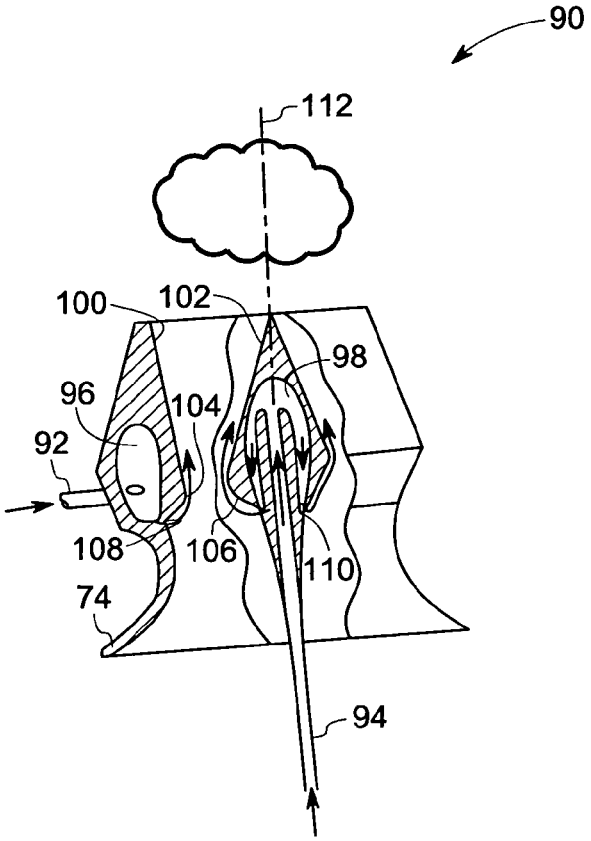
FIG. 5 is a diagrammatical illustration of another exemplary configuration of the premixing device employed in the combustors of FIGS. 2 and 3 in accordance with aspects of the present technique.

FIG. 5 is a diagrammatical illustration of another exemplary configuration of the premixing device 90 employed in the combustors of FIGS. 2 and 3, for substantially larger air flows and fuel staging capabilities. In the embodiment illustrated in FIG. 5, the premixing device 90 includes a dual-mixing configuration nozzle that facilitates wall and center mixing. The premixing device 90 includes fuel inlet lines 92 and 94 and fuel plenums 96 and 98 to independently provide the fuel for wall and center mixing. Further, the diffuser wall and the center body are represented by reference numerals 100 and 102 respectively. The fuel from the fuel plenums 96 and 98 is directed to flow over pre-determined profiles 104 and 106 via the fuel outlets 108 and 110. The premixing device 90 receives an airflow along the centerline 112 of the device 90 and facilitates mixing of the air and fuel within the device 90. The pre-determined profile may be designed to facilitate the mixing within the premixing device based on the Coanda effect that will be described in greater detail below.

The embodiment illustrated above is particularly utilized if the number of premixing devices 90 is required to be reduced in the combustor 40 and the size of the devices 90 is increased for obtaining scale-up of the system. In this embodiment, the fuel center body is employed to maintain the desired degree of premixing with the larger scale system. It should be noted that the center body may or may not be movable along the axial direction. Furthermore, this configuration also allows staging by independently operating a desired number of premixing devices 90 in the combustor 40 with either center body or the wall fuel supply. Advantageously, this configuration facilitates improved turndown, substantially lower emissions and combustion dynamics.

Figure 6:
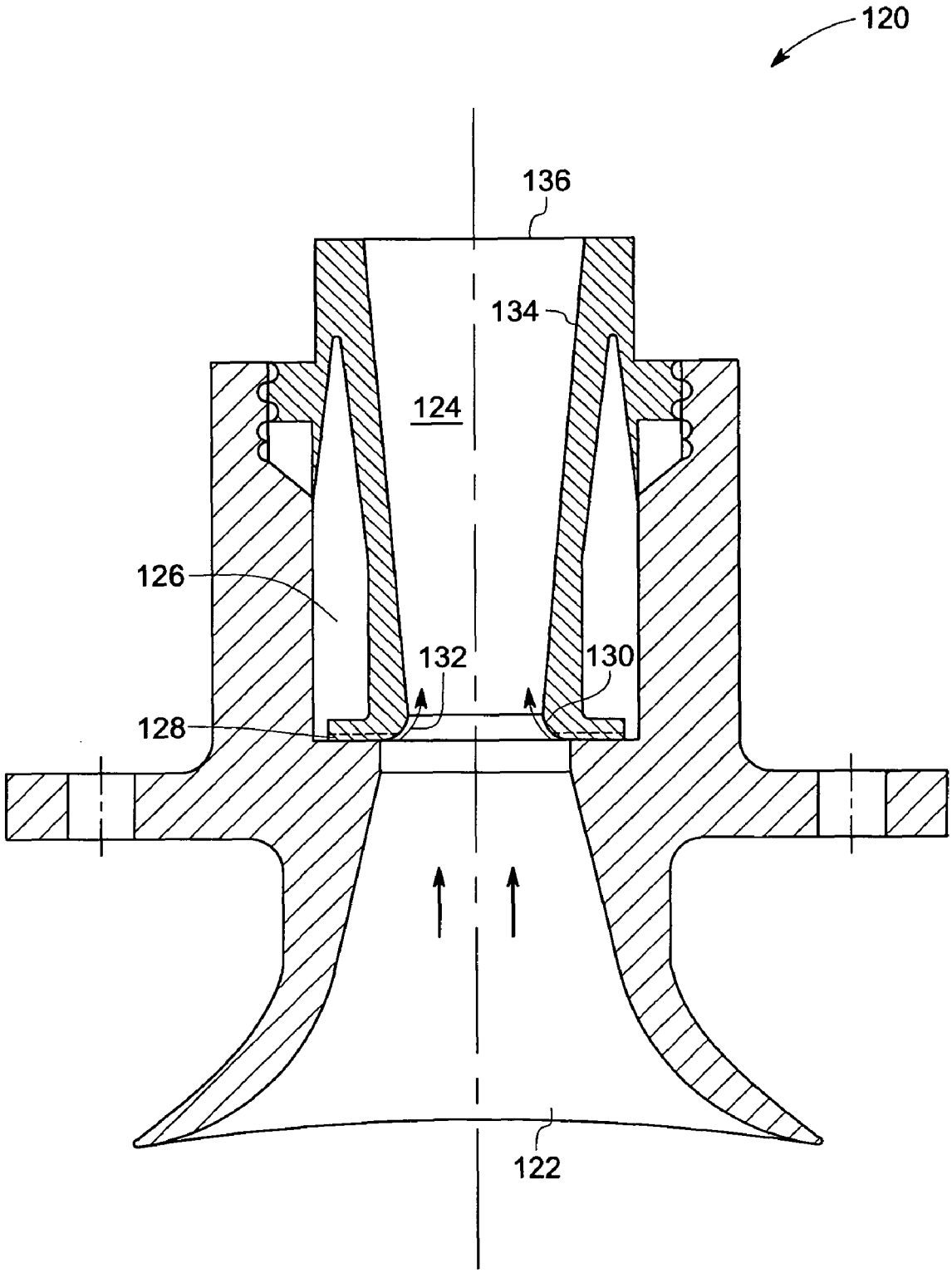
FIG. 6 is a cross-sectional view of an exemplary configuration of the premixing device employed in the combustor of FIG. 1 in accordance with aspects of the present technique.

FIG. 6 is a cross-sectional view of an exemplary configuration 120 of the premixing device employed in the combustor 12 of FIG. 1. In the embodiment illustrated in FIG. 6, the premixing device 120 includes an air inlet 122 configured to introduce compressed air into a mixing chamber 124 of the premixing device 120. Further, the premixing device 120 includes a fuel plenum 126 configured to provide a fuel to the mixing chamber 124 via a circumferential slot 128. The fuel introduced via the circumferential slot 128 is deflected over a pre-determined profile 130 as represented by reference numeral 132. In this exemplary embodiment, the premixing device 120 has an annular configuration and the fuel is introduced radially in and across the pre-determined profile 130. The geometry and dimensions of the pre-determined profile 130 may be selected/optimized based upon a desired premixing efficiency and the operational conditions including factors such as, but not limited to, fuel pressure, fuel temperature, temperature of incoming air, and fuel injection velocity. Examples of fuel include natural gas, high hydrogen gas, hydrogen, biogas, carbon monoxide and syngas. However, a variety of other fuels may be employed. In the illustrated embodiment, the pre-determined profile 130 facilitates attachment of the introduced fuel to the profile 130 to form a fuel boundary layer based upon the Coanda effect. Additionally, the fuel boundary layer formed adjacent the pre-determined profile 130 facilitates air entrainment thereby enhancing the mixing efficiency of the premixing device 120 within the mixing chamber 124.

In this embodiment, the incoming air is introduced in the premixing device 120 via the air inlet 122. In certain embodiments, the flow of air may be introduced through a plurality of air inlets that are disposed upstream or downstream of the circumferential slot 128 to facilitate mixing of the air and fuel within the mixing chamber 124. Similarly, the fuel may be injected at multiple locations through a plurality of slots along the length of the premixing device 120. In one embodiment, the premixing device 120 may include a swirler (not shown) disposed upstream of the device 120 for providing a swirl movement in the air introduced in the mixing chamber 124. In another embodiment, a swirler (not shown) is disposed at the fuel inlet gap for introducing swirling movement to the fuel flow across the pre-determined profile 130. In yet another embodiment the air swirler is placed at the same axial level and co-axial with the premixing device 120, at the outlet plane from the premixing device 120.

Moreover, the premixing device 120 also includes a diffuser 134 having a straight or divergent profile for directing the fuel-air mixture formed in the mixing chamber 124 to the combustion section via an outlet 136. In one embodiment, the angle for the diffuser 134 is in a range of about +/−0 degrees to about 25 degrees. The degree of premixing of the premixing device 120 is controlled by a plurality of factors such as, but not limited to, the fuel type, geometry of the pre-determined profile 130, degree of pre-swirl of the air, size of the circumferential slot 128, fuel pressure, fuel temperature, temperature of incoming air, length and angle of diffuser 134 and fuel injection velocity. In the illustrated embodiment, the fuel temperature is in a range of about 0° F. to about 500° F. and the temperature of the incoming air is in the range of about 100° F. to about 1300° F. The premixing of fuel and air within the mixing chamber 124 is described below with reference to FIGS. 7 and 8.

Figure 7:
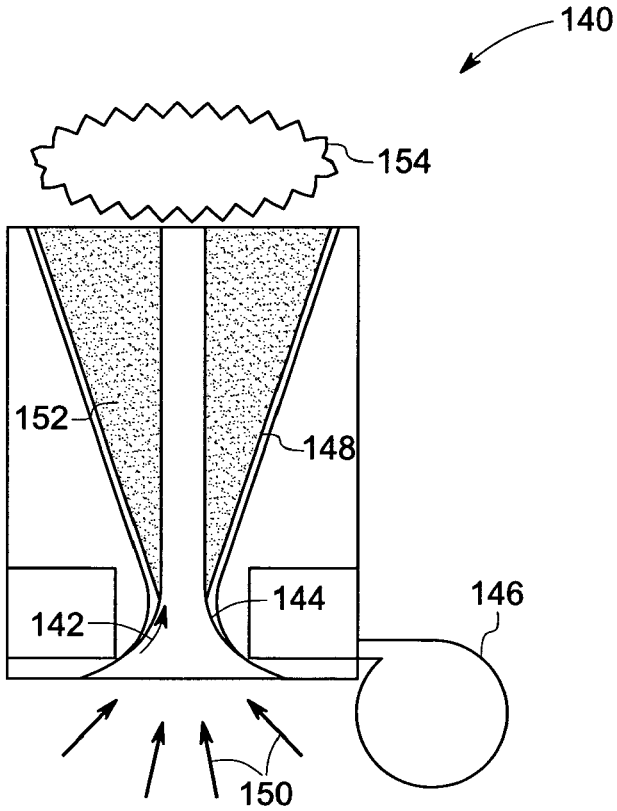
FIG. 7 is a diagrammatical illustration of flow profiles of air and fuel within the premixing device of FIG. 2 in accordance with aspects of the present technique.

FIG. 7 is a diagrammatical illustration of flow profiles 140 of air and fuel within the premixing device 120 of FIG. 6. As illustrated, a fuel 142 is directed inside the premixing device 120 (see FIG. 6) and over a pre-determined profile 144. In certain embodiments, a pump 146 may be employed to boost the fuel pressure of fuel 142 from the fuel plenum 126 (see FIG. 6). In the illustrated embodiment, the fuel 142 is introduced into the premixing device 120 at a substantially high velocity. In operation, the pre-determined profile 144 facilitates attachment of the fuel with the profile 46 to form a fuel boundary layer 148. In this embodiment, the geometry and the dimensions of the profile 144 are optimized to achieve a desired premixing efficiency. Further, a flow of incoming air 150 is entrained by the fuel boundary layer 148 to form a shear layer 152 with the fuel boundary layer 148 for promoting the mixing of the incoming air 150 and fuel 142. In this embodiment, the fuel 142 is supplied at a pressure relatively higher than the pressure of the incoming air 150. In one embodiment, the fuel pressure is about 1% to about 25% greater than the pressure of the incoming air 150. Moreover, the mixing of the air 150 and fuel 142 is enhanced due to the separation of the fuel boundary layer 148 downstream of the location of its introduction due to a negative pressure gradient. Thus, the shear layer 152 formed by the detachment and mixing of the boundary layer 148 with the entrained air 150 facilitates formation of a rapid and uniform mixture within the premixing device 120.

In one embodiment, the emerging mixed flow from the premixing device 120 is flow stabilized using an external moderate swirler disposed downstream of the premixing device 120. In another embodiment, the fuel 142 may be introduced with a swirled movement across the profile 144. The Coanda effect generated within the premixing device 120 facilitates a relatively high degree of premixing prior to combustion thereby substantially reducing pollutant emissions from a combustion system. In particular, the ability of the fuel to attach to the profile 144 due to the Coanda effect and subsequent air entrainment results in a relatively high premixing efficiency of the premixing device 120 before combustion 154. The attachment of fuel 142 to the profile 144 due to the Coanda effect in the premixing device 120 will be described in detail below with reference to FIG. 8.

Figure 8:
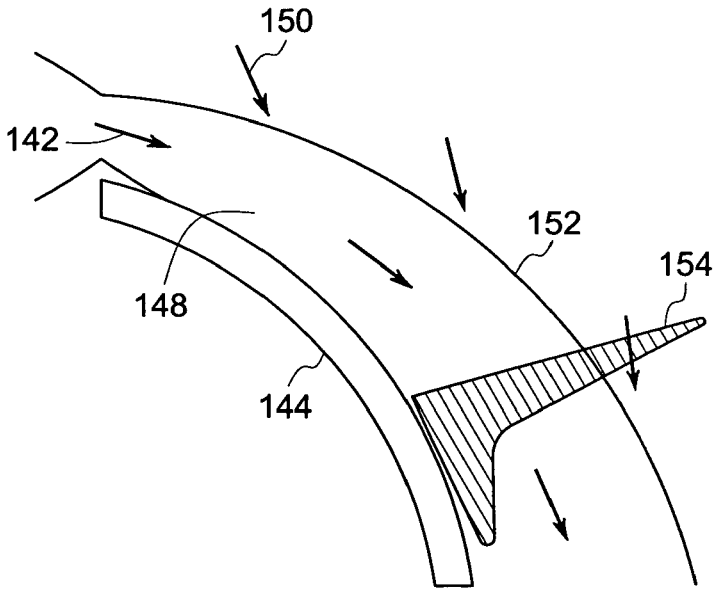
FIG. 8 is a diagrammatical illustration of the formation of fuel boundary layer adjacent a profile in the premixing device of FIG. 2 based upon a Coanda effect in accordance with aspects of the present technique.

FIG. 8 is a diagrammatical illustration of the formation of fuel boundary layer adjacent the profile 144 in the premixing device of FIG. 7 based upon the Coanda effect. In the illustrated embodiment, the fuel flow 142 attaches to the profile 144 and remains attached even when the surface of the profile 144 curves away from the initial fuel flow direction. More specifically, as the fuel flow 142 accelerates to balance the momentum transfer there is a pressure difference across the flow, which deflects the fuel flow 142 closer to the surface of the profile 144. As will be appreciated by one skilled in the art as the fuel 142 moves across the profile 144, a certain amount of skin friction occurs between the fuel flow 142 and the profile 144. This resistance to the flow 142 deflects the fuel 142 towards the profile 144 thereby causing it to stick to the profile 144. Further, the fuel boundary layer 148 formed by this mechanism entrains incoming airflow 150 to form a shear layer 152 with the fuel boundary layer 148 to promote mixing of the airflow 150 and fuel 142. Thus, injection of fuel through a circumferential slot and across a profile designed to facilitate Coanda effect generates a driving force that drives an oxidizer, such as air to accelerate. Furthermore, the shear layer 152 formed by the detachment and mixing of the fuel boundary layer 148 with the entrained air 150 results in a uniform mixture.

Figure 9:
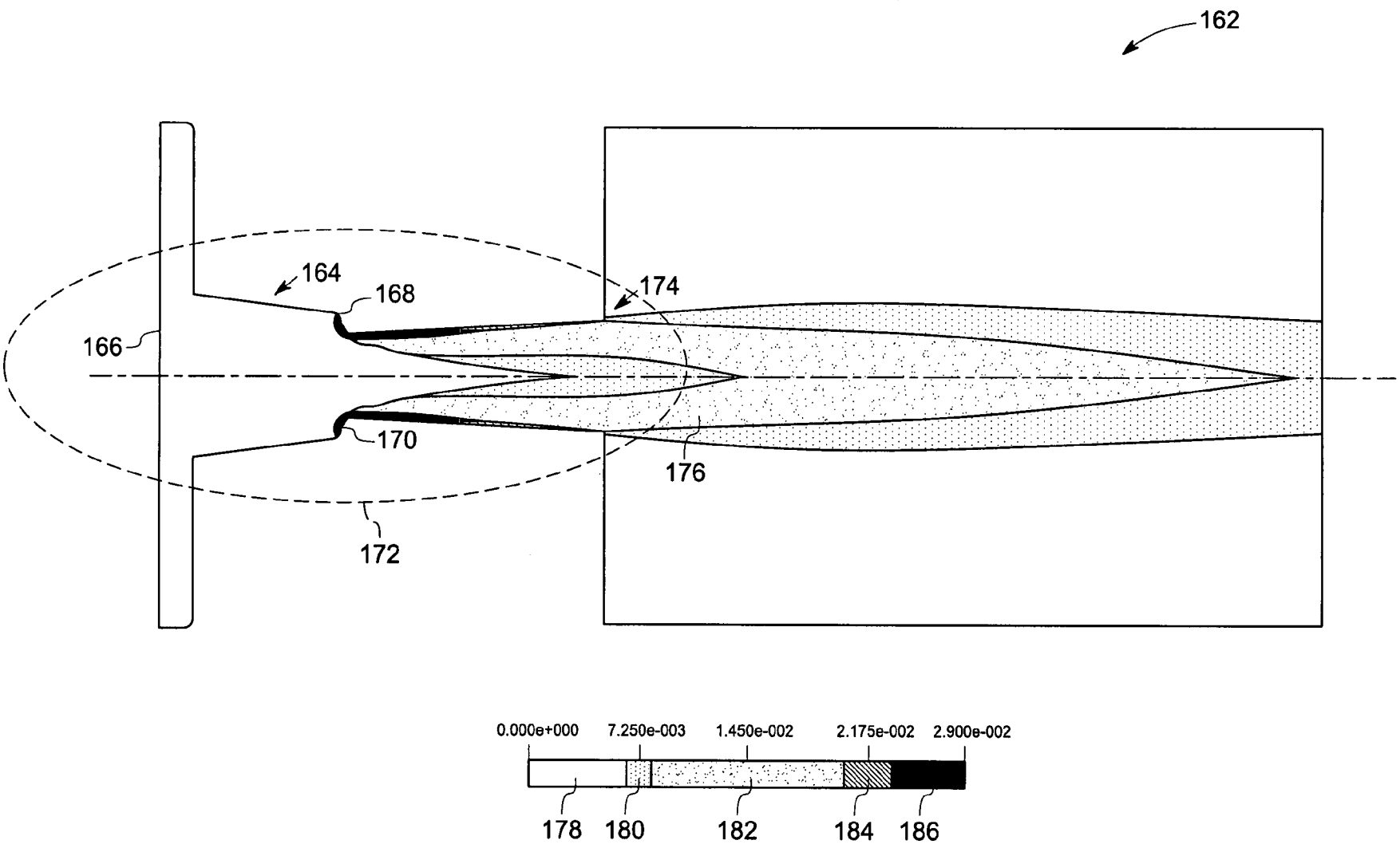
FIG. 9 represents exemplary computational fluid dynamics (CFD) simulation results illustrating premixing capability of a hydrogen premixing device having a Coanda profile in accordance with aspects of the present technique.

FIG. 9 represents exemplary computational fluid dynamics (CFD) simulation results 162 for a hydrogen premixing device 164 having a Coanda profile. The hydrogen premixing device 164 receives air from an air inlet 166 and the fuel is introduced into the device from a fuel inlet 168 and over a pre-determined profile 170. The mixing of the incoming air and hydrogen is achieved in a mixing zone 172 and the fuel-air mixture is released via a nozzle outlet 174. The test results for mixture fraction in the mixing zone 172 and a lean flame region 176 are represented by reference numerals 178-186. As used herein, the term "mixture fraction" refers to the volumetric amount of hydrogen in the air. As illustrated, the premixing device having a Coanda profile promotes the mixing of hydrogen and air prior to combustion. Further, inside the downstream tube the rich zones are substantially eliminated due to the enhanced premixing. In addition, hydrogen sticks to the walls of the premixing device 164 and the stoichiometry there does not allow a flame to exist there thereby enabling reduced temperatures adjacent to the walls of the premixing device 164. In particular, the negative pressure gradient of the fuel-air mixture within the premixing device 164 substantially prevents the attachment of the fuel adjacent to the walls of the premixing device 164.

Figure 10:
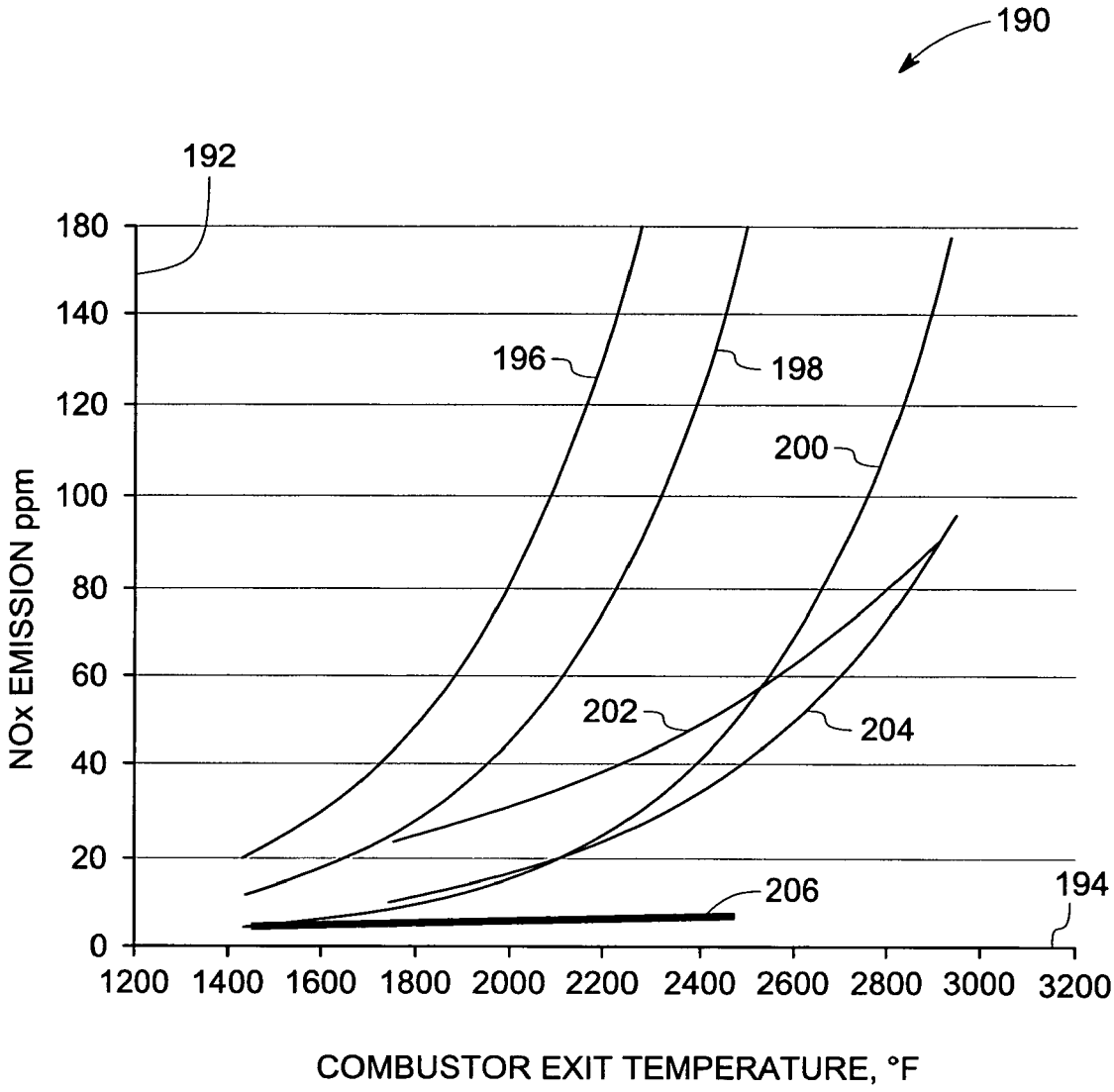
FIG. 10 is a graphical representation of exemplary test results for NOx emissions from combustor of FIG. 1 and for existing combustors employing pure hydrogen as fuel and air as oxidizer in accordance with aspects of the present technique.

FIG. 10 is a graphical representation of exemplary test results 190 for NOx emissions from combustor of FIG. 1 and for existing combustors employing pure hydrogen as fuel and air as oxidizer. In the embodiment illustrated in FIG. 10, the ordinate axis 192 represents the $NO_x$ emissions measured in parts per million (ppm) and the abscissa axis 194 represents combustor exit temperature measured in ° F. The emissions from existing combustors are represented by profiles 196-204. Furthermore, 206 represents emission profile from the combustor having the premixing device as described above. As illustrated, emissions 206 from the combustor employing the premixing device based upon the Coanda effect are substantially lower than the emissions 196-204 from existing combustors. Advantageously, the premixing device described above facilitates enhanced premixing of the fuel and air prior to combustion thereby substantially reducing the emissions.

Figure 12:
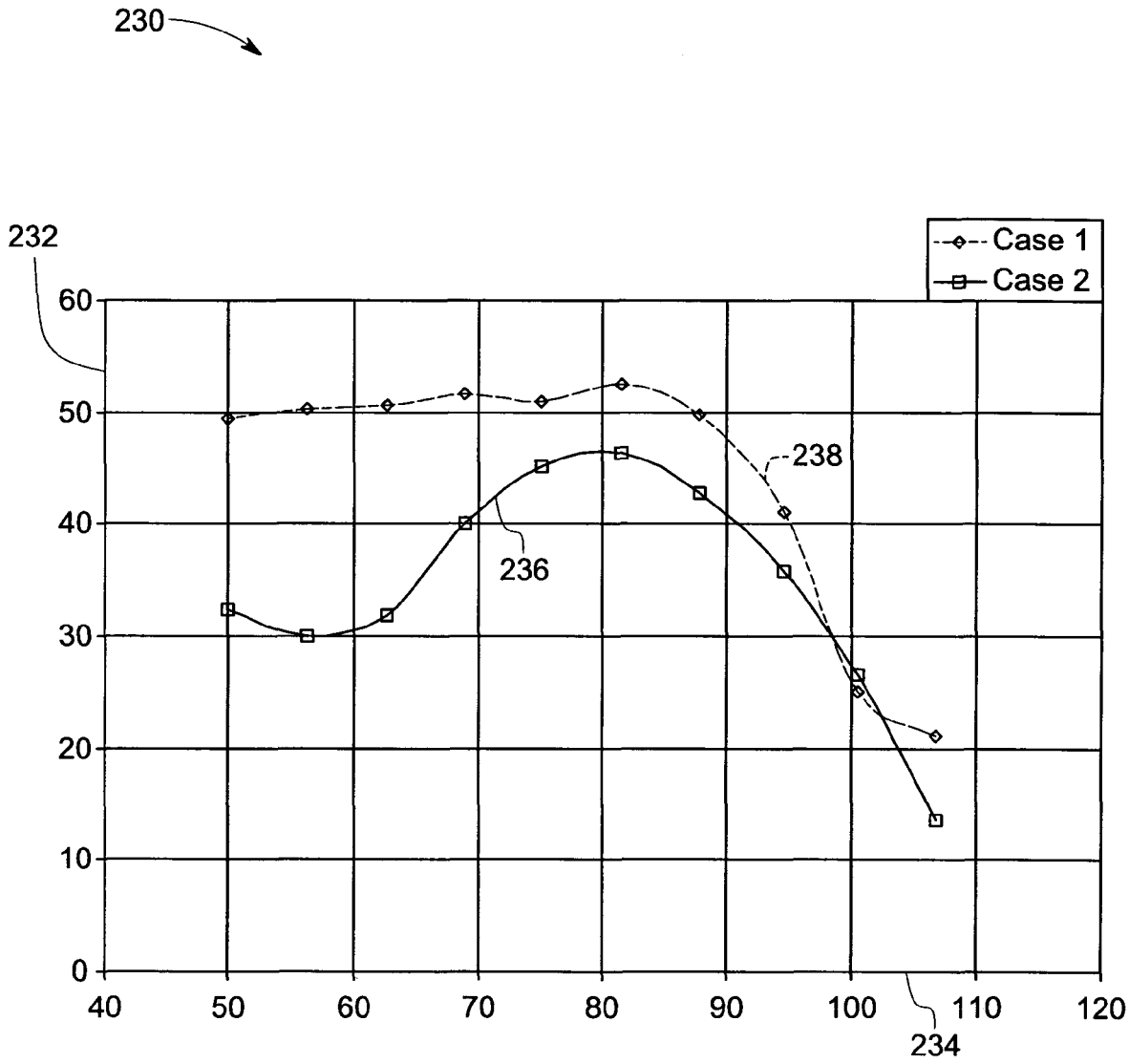
FIG. 12 is a graphical representation of the exemplary results of FIG. 11 in accordance with aspects of the present technique.

FIG. 11 represents exemplary results 210 illustrating degree of non-reacting gases premixedness of the premixing device with helium supplied as fuel and using atmospheric air entrained in the mixer. In the illustrated embodiment, reference numerals 212 and 214 represent results for helium supply pressures of about 9 psig and 15 psig at about 0.4 inches above the exit of the premixing device. As illustrated, reference numeral 216 indicates the time of measurement, 218 indicates the percentage traverse (i.e., the position of probe in percentage of the diameter size, with 50% being the centerline and 100% the wall of the mixer). It should be noted that the percentage traverse is measured along the diameter of the premixing device at about 0.4 inches above the exit of the premixing device. Further, reference numerals 220 and 222 indicate the measured percentage of helium and oxygen respectively and reference numeral 224 represents the measured percentage of carbon monoxide along with nitrogen in the mixture. In this embodiment, a mass spectrometer is employed to simultaneously measure the percentage of helium, oxygen, carbon monoxide and nitrogen from a sample of the mixture extracted at various traverse positions. The exemplary results 210 of the premixing device for the helium plenum (or supply) pressure levels 9 psig and 15 psig are further illustrated as a graphical representation 230 in FIG. 12.

In the illustrated embodiment, the ordinate axis 232 is indicative of the helium concentration and therefore degree of premixedness and the abscissa axis 234 represents distance from the centerline of the premixing device. As illustrated, a profile 236 represents the helium concentration in the mixture and therefore degree of premixedness for the doping level of 9 psig and a profile 238 represents the helium volumetric concentration in the mixture and therefore degree of premixedness for the doping level of 15 psig. As can be seen, the profiles 236 and 238 are substantially uniform thus indicating a high degree of premixedness due to the entrainment of atmospheric air within the premixing device via the Coanda effect described above.

The premixing devices described above may also be employed in gas to liquid system to facilitate premixing of oxygen and the natural gas prior to reaction in a combustor of the gas to liquid system. Typically, a gas to liquid system includes an air separation unit, a gas processing unit and a combustor. In operation, the air separation unit separates oxygen from air and the gas processing unit prepares natural gas for conversion in the combustor. The oxygen from the air separation unit and the natural gas from the gas processing unit are directed to the combustor where the natural gas and the oxygen are reacted at an elevated temperature and pressure to produce a synthesis gas. In this embodiment, the premixing device is coupled to the combustor to facilitate the premixing of oxygen and the natural gas prior to reaction in the combustor. Further, at least one surface of the premixing device has a pre-determined profile, wherein the pre-determined profile deflects the oxygen to facilitate attachment of the oxygen to the profile to form a boundary layer, and wherein the boundary layer entrains incoming natural gas to enable the mixing of the natural gas and oxygen at very high fuel to oxygen equivalence ratios (e.g. about 3.5 up to about 4 and beyond) to maximize syngas production yield while minimizing residence time. In certain embodiment, steam may be added to the oxygen or the fuel to enhance the process efficiency.

The synthesis gas is then quenched and introduced into a Fischer-Tropsh processing unit, where through catalysis, the hydrogen gas and carbon monoxide are recombined into long-chain liquid hydrocarbons. Finally, the liquid hydrocarbons are converted and fractionated into products in a cracking unit. Advantageously, the premixing device based on the Coanda effect facilitates rapid premixing of the natural gas and oxygen and a substantially short residence time in the gas to liquid system.

The various aspects of the method described hereinabove have utility in different applications such as combustors employed in gas turbines and heating devices such as furnaces. Furthermore, the technique described here enhances the premixing of fuel and air prior to combustion thereby substantially reducing emissions and enhancing the efficiency of systems like gas turbines, internal combustion engines and appliance gas burners. The premixing technique can be employed for different fuels such as, but not limited to, gaseous fossil fuels of high and low volumetric heating values including natural gas, hydrocarbons, carbon monoxide, hydrogen, biogas and syngas. Thus, the premixing device may be employed in fuel flexible combustors for integrated gasification combined cycle (IGCC) for reducing pollutant emissions. In addition, the premixing device may be employed in gas range appliances. In certain embodiments, the premixing device is employed in aircraft engine hydrogen combustors and other gas turbine combustors for aero-derivatives and heavy-duty machines. In particular, the premixing device described may facilitate substantial reduction in emissions for systems that employ fuel types ranging from low British Thermal Unit (BTU) to high hydrogen and pure hydrogen Wobbe indices. Further, the premixing device may be utilized to facilitate partial mixing of streams such as oxy-fuel that will be particularly useful for carbon dioxide free cycles and exhaust gas recirculation.

Thus, the premixing technique based upon the Coanda effect described above enables enhanced premixing and flame stabilization in a combustor. Further, the present technique enables reduction of emissions, particularly NOx emissions from such combustors thereby facilitating the operation of the gas turbine in an environmentally friendly manner. In certain embodiments, this technique facilitates minimization of pressure drop across the combustors, more particularly in hydrogen combustors. In addition, the enhanced premixing achieved through the Coanda effect facilitates enhanced turndown, flashback resistance and increased flameout margin for the combustors.

In the illustrated embodiment, the fuel boundary layer to the walls via the Coanda effect results in substantially higher level of fuel concentration at the wall including at the outlet plane of the premixing device. Further, the turndown benefits from the presence of the higher concentration of fuel at the wall thereby stabilizing the flame. Thus, the absence of a flammable mixture next to the wall and the presence of 100% fuel at the walls determine the absence of the flame in that region, thereby facilitating enhanced flashback resistance. It should be noted that the flame is kept away from the walls thus facilitating better turndown thereby allowing for operation on natural gas and air as low as having an equivalence ratio of about 0.2. Additionally, the flameout margin is significantly improved as compared to existing systems. Further, as described earlier this system may be used with a variety of fuels thus providing fuel flexibility. For example, the system may employ either NG or H2, for instance, as the fuel. The fuel flexibility of such system eliminates the need of hardware changes or complicated architectures with different fuel ports required for different fuels. As described above, the premixing device described above may be employed with a variety of fuels thus providing fuel flexibility of the system. Moreover, the technique described above may be employed in the existing can or can-annular combustors to reduce emissions and any dynamic oscillations and modulation within the combustors. Further, the illustrated device may be employed as a pilot in operating existing combustors.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A premixing device, comprising:

a compressor configured to compress ambient air;

an air inlet configured to introduce compressed air received from the compressor into a mixing chamber of the premixing device; and a fuel plenum configured to provide a fuel to the mixing chamber via a circumferential slot and over a pre-determined profile adjacent the fuel plenum, wherein the pre-determined profile facilitates attachment of the fuel to the pre-determined profile to form a fuel boundary layer and to entrain incoming air through the fuel boundary layer to facilitate mixing of fuel and air in the mixing chamber.

2. The premixing device of claim 1, wherein the pre-determined profile deflects the fuel supplied through the circumferential slot towards the pre-determined profile via a Coanda effect.

3. The premixing device of claim 1, further comprising a swirler disposed upstream of the device and configured to provide a swirl movement in the air introduced into the mixing chamber.

4. The premixing device of claim 1, comprising a plurality of air inlets disposed upstream, or downstream of the circumferential slot to facilitate mixing of air and fuel within the mixing chamber.

5. The premixing device of claim 1, comprising a plurality of slots along the length of the premixing device for introducing the fuel at a plurality of locations within the mixing chamber.

6. The premixing device of claim 1, wherein the air supplied through the air inlet forms a shear layer with the fuel boundary layer to facilitate mixing of air and fuel.

7. The premixing device of claim 1, wherein a degree of premixing is controlled by a fuel type, or a geometry of the pre-determined profile, or a degree of pre-swirl of the air, or a size of the circumferential slot, or a fuel pressure, or a temperature of the fuel, or a temperature of the air, or a length of premixing, or a fuel injection velocity, or combinations thereof.

8. The premixing device of claim 1, further comprising a diffuser having a divergent profile for directing the fuel-air mixture formed from the mixing of the fuel and the air to a combustion section for combustion.

9. The premixing device of claim 1, wherein the premixing device is configured to substantially reduce pollutant emissions.

10. The premixing device of claim 1, wherein the premixing device is configured for use in a gas turbine combustor, or a gas range.

11. The premixing device of claim 10, wherein the gas turbine combustor comprises a can combustor, or a can-annular combustor, or an annular combustor.

12. The premixing device of claim 1, wherein the fuel comprises natural gas, or high hydrogen gas, or hydrogen, or bio gas, or carbon monoxide, or a syngas.

13. The premixing device of claim 12, wherein the fuel is supplied at a pressure relatively higher than a pressure of the air.

14. A low emission combustor, comprising:

a combustor housing defining a combustion area;

a compressor in flow communication with the combustor and configured to compress ambient air; and a premixing device coupled to the combustor, wherein the premixing device comprises:

an air inlet to introduce compressed air received from the compressor inside the premixing device;

a fuel plenum configured to provide a fuel to the premixing device via a circumferential slot; and at least one surface of the premixing device having a pre-determined profile, wherein the pre-determined profile is configured to facilitate attachment of the fuel to the pre-determined profile to form a boundary layer and to entrain incoming air from the air inlet to promote the mixing of air and fuel.

15. The combustor of claim 14, further comprising a swirler disposed downstream of the premixing device to facilitate stabilization of the flow of a fuel-air mixture formed from the mixing of the air and the fuel from the premixing device.

16. The combustor of claim 14, wherein the pre-determined profile is selected to deflect the fuel towards the pre-determined profile based upon a Coanda effect.

17. The combustor of claim 14, wherein the premixing device is configured to substantially reduce pollutant emissions from the combustor.

18. The combustor of claim 14, wherein the fuel comprises natural gas, or high hydrogen gas, or hydrogen, or bio gas, or carbon monoxide, or a syngas.

19. The combustor of claim 18, wherein the fuel comprises pure hydrogen.

20. A method for premixing a fuel and oxidizer in a combustion system, comprising:

compressing the oxidizer using a compressor in flow communication with the combustion system;

drawing the oxidizer inside a premixing device through an oxidizer inlet;

injecting the fuel into the premixing device through a circumferential slot;

deflecting the injected fuel towards a pre-determined profile within the premixing device to form a fuel boundary layer;

introducing the oxidizer at a plurality of locations upstream, or downstream of the circumferential slot to facilitate mixing; and entraining the oxidizer through the fuel boundary layer to facilitate mixing of the fuel and oxidizer to form a fuel-air mixture.

21. The method of claim 20, wherein the oxidizer comprises air or, an oxidizer having a volumetric content of about 10% oxygen.

22. The method of claim 20, wherein the oxidizer comprises syngas and the fuel comprises high purity oxygen for use in oxy-fuel combustors.

23. The method of claim 20, further comprising flowing the fuel-oxidizer mixture from the premixing device into the combustion system and subsequently igniting the mixture within the combustion system.

24. The method of claim 20, wherein the entrained oxidizer forms a shear layer with the fuel boundary layer to promote mixing of oxidizer and fuel.

25. The method of claim 20, comprising injecting the fuel at a plurality of locations along the length of the premixing device.

26. A method for reducing emissions from a combustion system, comprising:

compressing ambient air using a compressor in flow communication with the combustion system;

introducing the compressed air at a plurality of locations upstream, or downstream of the combustion system;

coupling a premixing device upstream of the combustion system, wherein the premixing device is configured to facilitate premixing of the compressed air and fuel by deflecting the fuel over a pre-determined profile to form a fuel boundary layer and subsequently entraining the compressed air through the fuel boundary layer to facilitate mixing of the fuel and air.

27. The method of claim 26, wherein deflecting the fuel over the pre-determined profile comprises inducing a Coanda effect via the pre-determined profile to facilitate attachment of the fuel to the pre-determined profile.

28. A gas turbine, comprising:

a compressor configured to compress ambient air;

a combustor in flow communication with the compressor, the combustor being configured to receive compressed air from the compressor assembly and to combust a fuel stream to generate a combustor exit gas stream;

a premixing device disposed upstream of the combustor to facilitate the premixing of air and the fuel stream prior to combustion in the combustor, wherein the premixing device comprises:

at least one surface of the premixing device having a pre-determined profile, wherein the pre-determined profile deflects the fuel stream to facilitate attachment of the fuel stream to the pre-determined profile to form a fuel boundary layer, and wherein the fuel boundary layer entrains incoming air to enable the mixing of the fuel stream and air; and a turbine located downstream of the combustor and configured to expand the combustor exit gas stream.

29. The gas turbine of claim 28, wherein the premixing device comprises an air inlet to introduce the compressed air into the premixing device.

30. The gas turbine of claim 28, wherein the premixing device comprises a fuel plenum to provide fuel over the pre-determined profile via a circumferential slot.

* * * * *